United States Patent [19]

Boxer et al.

[11] Patent Number: 4,526,298

[45] Date of Patent: Jul. 2, 1985

[54] SPORT HYDRATION SYSTEM

[75] Inventors: Michael A. Boxer, Great Neck, N.Y.; Ben A. Posdal, Bridgewater, N.J.

[73] Assignee: CardioSearch, Inc., Somerville, N.J.

[21] Appl. No.: 470,049

[22] Filed: Feb. 28, 1983

[51] Int. Cl.[3] ..... B67D 5/64

[52] U.S. Cl. ..... 222/130; 222/175; 222/529; 224/148

[58] Field of Search ..... 222/175, 130, 529, 383; 239/152–154; 224/148, 208, 210, 215, 907; 285/323

[56] References Cited

U.S. PATENT DOCUMENTS

| | | | |
|---|---|---|---|
| 1,902,548 | 3/1933 | Fenwick | 222/175 |
| 2,558,181 | 6/1951 | Kassel | 222/175 |
| 2,789,396 | 4/1957 | Jernander et al. | 222/175 |
| 3,650,473 | 3/1972 | Malone | 222/383 |
| 3,743,326 | 7/1973 | Courtot et al. | 285/323 |
| 4,095,726 | 6/1978 | Hechler et al. | 222/175 |
| 4,139,130 | 2/1979 | Glusker et al. | 224/148 |

FOREIGN PATENT DOCUMENTS

| | | | |
|---|---|---|---|
| 212578 | 4/1955 | Australia | 222/175 |

*Primary Examiner*—H. Grant Skaggs

*Attorney, Agent, or Firm*—Hoffmann, Dilworth, Barrese & Baron

[57] ABSTRACT

A hydration system includes a refillable flexible liquid container or bag that is suspended from the shoulders much like a hiker's back pack with the weight of the liquid disposed on a centered position at the anatomic pivot point in the small of the back of the user. A trigger-actuated pump type liquid dispenser is attached to the bottom of the bag by a kink-free flexible coiled tube. The dispenser includes a nozzle that is adjustable between "stream" and "spray" positions, and has a hook and loop patch thereon which cooperates with a similar patch on a front strap of the suspension system for the ready attachment of the dispenser to the front strap of the suspension system and the removal of the dispenser therefrom. In a modification the walls of the container are insulated in order to maintain the temperature of the contents at a desired level.

5 Claims, 7 Drawing Figures

SPORT HYDRATION SYSTEM

BACKGROUND OF THE INVENTION

1. Field of the Invention

The present invention relates to a hydration system for use by runners and other athletes who have need for a water or other liquid supply close at hand for facilitating the intake of liquid thereby to avoid dehydration.

2. Description of the Prior Art

It is known in the prior art that heat and dehydration are the most serious threats to the health of runners and other athletes and even those engaged in strenuous manual labor such as digging ditches. A delicate balance of vital fluids is required for the body to function well. When the amount of water lost to the environment exceeds that taken in, the resulting body dysfunction can range from mild lethargy to cramps, exhaustion, and death. The effects on athletes of running and jumping in hot and humid weather is discussed in depth in the article, "Cooling Off," by Eric Olsen that appeared in the June 1981 issue of *The Runner*, and in the article, "Body Fluids," by Richard Pearce, Ph.D. that appeared in the April 1982 issue of *Runner's World*.

Hydration systems have been proposed in the prior art for freeing runners during extended runs from dehydration worries comprising belts designed to be worn about the waist or arm, belts which, in one form, comprise water belts that are self-contained, that is, which directly contain water or other liquid, and which, in another form, are provided with a pocket or pockets for holding cans or bottles of liquid. Such hydration systems are disclosed in advertisements that appeared on pages 13, 19 and 20 of *The Runner* for June 1981. A jogger's water belt is advertised in the August 1979 issue of *Runner's World*. That belt is provided with a flexible tube which has one end connected to the belt and a dispenser at the other end for insertion in the runner's mouth for enabling drinking on the run, apparently by squeezing the belt and/or sucking on the dispenser.

Hydration systems are utilized for the purpose of enabling runners to quench their thirst without having to plan their running routes around drinking fountains or stashing containers of liquid around the route, thus providing new freedom, particularly in long training by opening routes with questionable water sources.

A disadvantage with the prior art hydration systems is the restrictive feeling and the sensation of weight about the waist, or arm when the belt is in the form of an armband, and also the need to stop when taking a drink from a bottle or attempting to douse using a bottle. Accordingly, there is a need and a demand for a hydration system that may be worn without experiencing such restrictive feeling and sensation of weight, and which includes a dispensing system which allows drinking and dousing, as desired, without stopping, changing stride or losing concentration that may distract a runner from his path.

SUMMARY OF THE INVENTION

An object of the invention is to provide an improved hydration system that may be carried by runners and other athletes without experiencing the restrictive feeling, sensation of weight, or irritation of belt-type systems around the waist or arm.

A further object of the invention is to provide such a hydration system that allows drinking and dousing without stopping, changing stride, or losing concentration.

Another object of the invention is to provide such a hydration system in which the suspension system is comprised of wide fabric straps that are of a breathable and comfortable material in the body contact areas.

In accomplishing these and other objectives of the invention, there is provided a hydration system in which the weight of the water or other liquid is suspended in a flexible container or bag from the shoulders much like a hiker's back pack, but on elastic straps. In accordance with the invention, the water weight is disposed on a centered position at the anatomic pivot point in the small of the back. As a result, the water weight is carried without the restrictive feeling or irritation of the belt-type systems around the waist or arm. The sensation of weight is greatly reduced through this geometry. The flexible container or bag reduces in bulk with the consumption of the contents. The load of the water container or bag is carried by a suspension system comprising adjustable elastic fabric straps that comfortably secure the bag and reduce vibration. The elastic straps desirably are made of a breathable and comfortable material in the body contact areas.

Also, in accordance with the invention, the hydration system includes a dispenser comprising a liquid spraying device at one end of a tube coil having the other end connected to the flexible container or bag. The spraying device includes a trigger-actuated pump and a nozzle that is easily adjustable between "stream" and "spray" positions. This allows drinking and dousing without stopping, changing stride or losing concentration that may distract a runner from his path. The arrangement of the tube coil, which is flexible, is such as to provide a self-adjustment around the body of the runner to insure maximum comfort on extended runs.

With this improved hydration system, runners are enabled to maintain continuity of their aerobic training and can take water or douse themselves without having to stop to take a drink from a water fountain or a stashed or carried bottle.

BRIEF DESCRIPTION OF THE DRAWINGS

Having summarized the invention, a detailed description follows with reference being had to the accompanying drawings which form part of the specification, of which.

DESCRIPTION OF THE PREFERRED EMBODIMENTS

Figure 1:
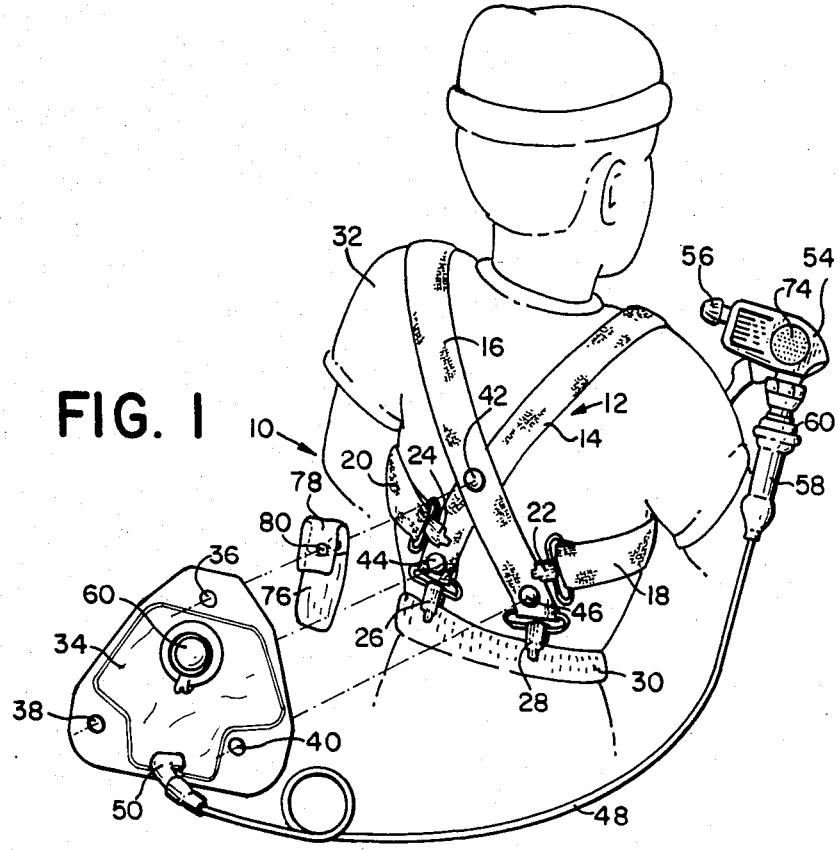
FIG. 1 is an exploded view illustrating the hydration system of the invention positioned on the back of a runner or other intended user and showing the front straps of the suspension system clipped to the rear straps.
Figure 2:
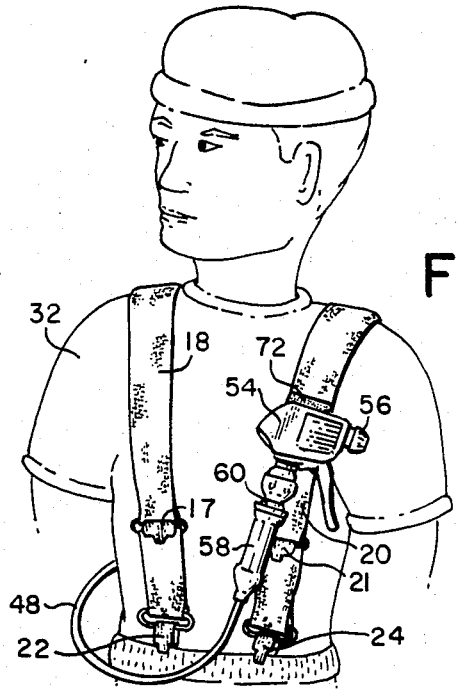
FIG. 2 is a view of the hydration system from the front of the runner and showing the straps of the suspension worn in conventional manner.

Referring to FIGS. 1 and 2 of the drawings, the hydration system, designated 10, includes a suspension system 12 comprising two straps having crossed rear strap portions 14 and 16 and front strap portions 18 and 20. In FIG. 1 front strap portions 18 and 20 are shown attached by a respective clip 22 and 24 to the rear strap portions 14 and 16, respectively. The rear strap portions 14 and 16 are attached by respective clips 26 and 28 to the running shorts 30 of a runner designated 32.

The suspension system 12, as illustrated in FIG. 2, may also be worn in conventional manner, that is, with the front strap portions 18 and 20 attached by their respective clips 22 and 24 to the shorts 30 of the runner 32 instead of to the rear strap portions 14 and 16 as shown in FIG. 1. As shown, the length of the front strap portions 18 and 20 may readily be adjusted by manipulation of respective adjustable clips 17 and 21 which may be of a type normally used to adjust the length of suspender straps for pants.

The straps of the suspension system desirably are wide, for example, two inches wide, and are made of an elastic fabric such as cotton terry that is breathable. The provision of suspension straps of such width and material, particularly in the body contact areas, serves to diminish any restrictive feeling, sensation of weight or irritation of the suspension system about the shoulders of the runner, thereby adding to the comfort of the runner.

Figure 3:
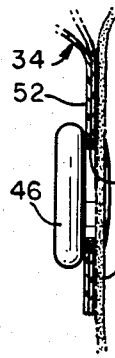
FIG. 3 is an enlarged cross sectional view of the fastening means, specifically button discs, employed in the hydration system for attaching the water container or bag to the supporting straps.
Figure 4:
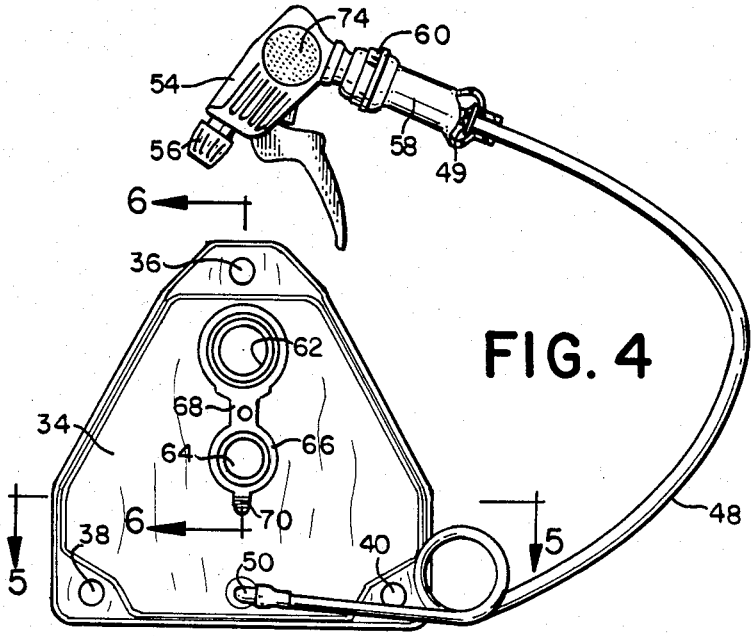
FIG. 4 is a partially fragmented view of the water bag, coiled dispensing tube and dispenser, the fill opening for the water bag being shown in open position.

The water container or bag, as indicated at 34 in FIGS. 1 and 4, may be made large enough to hold a quantity of water sufficient for extended runs, for example, one liter of water, and is made of a clear plastic such as polyvinyl chloride or other polymer. As shown, the bag 34 is generally frusto-conical in plan outline and has three mounting holes 36, 38 and 40 for mounting the bag 34 on the suspension system 12. Thus, mounting holes 36, 38 and 40 are adapted to engage respective, identical reflective button discs 42, 44 and 46 that are provided on the strap portions 14 and 16 of the suspension system 12. A cross section of the button disc 46 is illustrated in FIG. 3.

Figure 5:
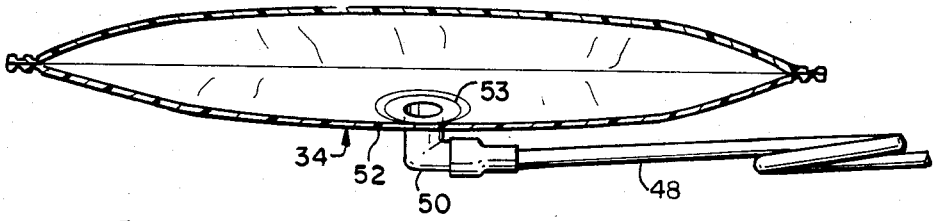
FIG. 5 is a cross section of the water bag taken along the lines 5—5 of FIG. 4.

Attached to the container 34, at a low position thereon, as seen in FIG. 1, is one end of a kink resistant coiled flexible tube 48, the attachment being by way of a right angle tube 50, as seen in FIG. 5, that is formed integrally with a thickened disc-shaped portion 53 of the wall 52 of bag 34. The other end of the coiled tube 48 is attached to the internal pump of a trigger-actuated liquid dispenser 54 that has an adjustable nozzle 56. Nozzle 56 may be selectively adjusted, as by rotating, to produce a conically shaped fine spray, a single stream, or graded variations between one and the other. A desirable characteristic of the dispenser 54 is a uniformity of liquid squirted per trigger actuation, this being approximately two milliliters per squirt. Dispenser 54 includes a trigger-actuated pump and desirably may be of a plastic type manufactured by The AFA Corporation as disclosed in the following U.S. Patents: Tyler No. 3,061,202, Malone No. 3,650,473 and Vanier No. 3,685,739.

For facilitating the connection of the coiled tube 48 to the dispenser 54 and for holding and manipulating the latter, there is provided a tubular handle 58 through which the coiled tube 48 extends, and an internal lock washer 49 embracing the tube 48 and serving to prevent the tube 48 from being pulled out of the handle 58 at the lower end thereof, as seen in FIG. 4. The upper end of handle 58 is connected by a coupling 60 to the dispenser 54, the coupler 60 being similar to the usual coupling employed to couple fluid dispensers to the neck of bottles or other containers from which fluid is to be dispensed.

Figure 6:
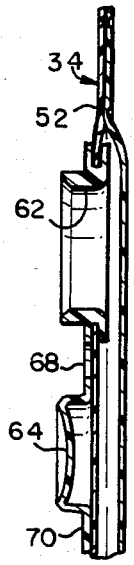
FIG. 6 is a cross section of the fill opening and closure cap for the water bag taken along the lines 6—6 of FIG. 4.

The bag 34 is provided with a relatively large fill opening comprising a plastic circular flanged member 62, as best seen in FIGS. 4 and 6 and that is adapted to be closed by a plastic closure cap 64. The closure cap 64 is cup-shaped and has a convex bottom. A flange 66 on the closure cap 64 is provided with a living hinge 68 at the lower side, as seen in FIGS. 4 and 6, and with a tab 70 at the upper side for opening the fill opening 62. When in the open position, the closure cap 62 hangs downwardly on the hinge 68, as shown.

If fluids other than water are used, it is necessary to flush the system with water after each use. In order to drain the water, the bag 34 preferably is held at a level higher than the dispenser 54, the dispenser 54 meanwhile being pumped to allow all remaining water to be removed. Desirably, the bag 34 should be stored with the coiled tube 48 tucked into the fill opening 62 thereby allowing air to circulate in the bag for drying.

As illustrated in FIG. 2, the coiled tube 48 hangs under the right arm of the intended user between the bag 34 and a hook and loop fastening means or patch 72 on the left front strap portion 20. A mating hook and loop fastening means or patch 74 is provided on the side of the dispenser 54, as seen in FIG. 4. Advantageously, patches 72 and 74 may be made of hook and loop fastener material that is sold commercially under the trademark VELCRO and disclosed in U.S. Pat. Nos. 2,717,437; 3,000,384; 3,009,235; 3,076,244; 3,130,111; 3,147,528; 3,154,837; 3,192,589; and 3,387,345. Such fastener material provides a means for the ready attachment to and removal of the dispenser 54 to the front strap portion 20, thus facilitating the use of the dispenser 54.

If desired, as illustrated in FIG. 1, an optional pouch 76 may be incorporated with the hydration system 10, being provided for carrying miscellaneous items such as change, keys, etc. As shown, the top or flap 78 of the pouch 76 is folded over so that the hole 80 of the flap lines up with a hole in the body of the pouch 76. The pouch 76 is then placed over the middle button disc 42 of the suspension system 12. The filled bag 34 is then buttoned over the pouch 76, using the three mounting holes 36, 38 and 40.

Figure 7:
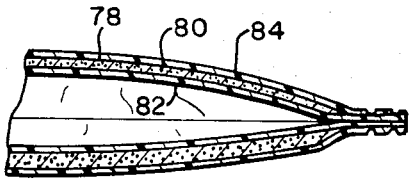
FIG. 7 is a fragmented cross sectional view of a modified form of water bag having utility in the hydration system of the invention.

The fragmented cross section of FIG. 7 illustrates a modification of the container or bag 34. The modified bag 78 of FIG. 7 includes a layer of suitable insulation 80 between an inner layer 82 of the wall of bag 78 and an outer layer 84 thereof. Such an insulated bag 78 serves to maintain a desired liquid temperature and is particularly useful to runners on extended runs.

Thus, there has been providing according to the invention an improved hydration system in which the weight of the water or other liquid and an optional change pouch, if desired, are disposed at the anatomic pivot in the small of the back of a user whereby the weight is carried without sensation of weight and without restrictive feeling or irritation. The container or bag is characterized in the substantial quantity of water that may be carried, one liter of water being entirely practical. The provision of the dispensing system including the trigger-actuated sprayer renders the hydration system 10 particularly useful for dousing and spraying as well as drinking, the system 10 being easy to use without interrupting activities or requiring tipping of the head back by the user. There is comfort and adjustability for a wide range of sizes is possible. Uniformity in the amount of liquid squirted per trigger actuation allows monitoring by the user of liquid intake rate.

The hydration system 10 of the invention is further characterized in that it can be worn under a jacket in cold weather. The provision of the tubular handle 58 in association with the dispenser provides a substantial hand grip and lever for ease of dispensing liquid. The provision of the kink resistant coiled tubing 48 insures uninterrupted flow. The large fill opening formed by the circular flanged member 62 contributes to the ease of filling the flexible container or bag 34. The use of the VELCRO fastener facilitates the fastening and removal of the dispenser 54 from the suspension system 12. Wide, comfortable suspension straps minimize any tendency to irritation or discomfort to the user of the hydration system.

What is claimed is:

1. A hydration system comprising:

a flexible liquid container having a fill opening for filling said container with liquid and having an outlet opening, a liquid dispensing device, a flexible tube having one end connected to the outlet opening of said container and the other end connected to said dispensing device, and a suspension system for supporting the entire weight of said liquid container and the contents thereof on a centered position at the anatomic pivot point in the small of the back of an intended user of the hydration system with the outlet opening at a lower position than the fill opening, wherein said suspension system comprises elastic shoulder straps having two rear strap portions and two front strap portions, said rear strap portions being crossed at a region in the middle of the back of an intended user with the ends thereof being adapted to be clipped to the shorts of the intended user, said rear strap portions being provided with a support button disc at the region of the cross over of said rear strap portions and with a similar support button disc adjacent the respective ends of said rear strap portions, said liquid container having spaced mounting holes for engagement with said support discs and thereby support by said suspension system.

2. A hydration system as specified in claim 1 wherein a hook and loop type patch is provided on one of said front strap portions of said suspension system and similar hook and loop patch is provided on one side of said liquid dispensing device whereby said liquid dispensing device may be readily fastened to and removed from said one front strap portion.

3. A hydration system as specified in claim 1 further including a pouch for holding miscellaneous items of the intended user, said pouch having a closing flap with mounting holes in the flap and pouch that are aligned when the flap is closed, said aligned pouch holes being placed over said support button disc at the region of the cross over of the rear strap portions with the associated mounting hole of the liquid container buttoned on said last mentioned support disc over said pouch.

4. A hydration system comprising:

a flexible liquid container having a fill opening for filling said container with liquid and having an outlet opening, a liquid dispensing device, a flexible tube having one end connected to the outlet opening of said container and the other end connected to said dispensing device, and a suspension system for supporting the entire weight of said liquid container and the contents thereof on a centered positioned at the anatomic pivot point in the small of the back of an intended user of the hydration system with the outlet opening at a lower position than the fill opening, wherein said dispensing device includes a trigger-actuated pump and a nozzle that is adjustable between positions that provide a liquid output in the form of a stream or a spray, wherein a tubular handle is provided in association with said liquid dispensing device for facilitating the use thereof, said handing being coupled to the intake portion of said dispensing device in enclosing relation with said flexible tube, wherein a gripping washer is provided in association with said flexible tube, internally of said tubular handle to restrain said tube from being pulled out of said handle and thereby separated from said dispensing device, wherein said suspension system comprises elastic shoulder straps having two rear straps portions and two front strap portions, said rear strap portions being crossed at a region in the middle of the back, of an intended user with the ends thereof being adapted to be clipped to the shorts of the intended user, said rear strap portions being provided with a support button disc at the region of the cross over of said rear strap portions and with a similar support button disc adjacent the respective ends of said rear strap portions, said liquid container having spaced mounting holes for engagement with said support discs and thereby support by said suspension system, wherein a hook and loop type patch is provided on one of said front strap portions of said suspension system and a mating hook and loop patch is provided on one side of said liquid dispensing device whereby said liquid dispensing device may be readily fastened to and removed from said one strap portion, further including a pouch for holding miscellaneous items of the intended user, said pouch having a closing flap with mounting holes in the flap and pouch that are aligned when the flap is closed, said aligned pouch holes being placed over said support button disc at the region of the cross over of the rear strap portions with the associated mounting hole of the liquid container buttoned on said last mentioned support disc over said pouch.

5. A hydration system as specified in claim 4 wherein said liquid container has an insulated wall whereby to maintain a desired temperature of the contents of said container.

* * * * *